United States Patent [19]

Webster et al.

[11] 4,017,333

[45] Apr. 12, 1977

[54] FINE GRAIN BERYLLIUM BODIES

[75] Inventors: Donald Webster, Saratoga; Donald D. Crooks, San Jose, both of Calif.

[73] Assignee: Lockheed Missiles & Space Company, Inc., Sunnyvale, Calif.

[22] Filed: Aug. 25, 1975

[21] Appl. No.: 607,675

[52] U.S. Cl. ..... 148/2; 148/11.5 R; 148/11.5 F

[51] Int. Cl.[2] ..... C22F 1/16

[58] Field of Search ..... 148/2, 11.5 F, 11.5 R; 75/150

[56] References Cited

UNITED STATES PATENTS

| | | | |
|---|---|---|---|
| 2,872,363 | 2/1959 | Macherey | 148/11.5 F |
| 3,333,994 | 8/1967 | Mallen et al. | 148/11.5 F |
| 3,350,241 | 10/1967 | Mallen et al. | 148/11.5 F |
| 3,699,798 | 10/1972 | Anderson, Jr. et al. | 148/11.5 F |
| 3,791,878 | 2/1974 | Taylor et al. | 148/11.5 F |

FOREIGN PATENTS OR APPLICATIONS

| | | | |
|---|---|---|---|
| 253,924 | 3/1962 | Australia | 75/150 |

*Primary Examiner*—W. Stallard
*Attorney, Agent, or Firm*—Richard H. Bryer; Billy G. Corber

[57] ABSTRACT

A method for enhancing the mechanical properties of cast beryllium and beryllium alloy bodies by reducing beryllium grain size. More particularly, grain size is reduced by forming a metal beryllide phase that is soluble in molten beryllium but of limited solubility in the solid metal. Initially, molten beryllium is cast into a mold and solidified resulting in precipitation of the metal beryllide in the form of finely divided particles at the beryllium grain boundaries. The cast body is then mechanically worked below its recrystallization temperature to form an unstable, deformed microstructure which is converted to a fine grain microstructure during a subsequent anneal above the recrystallization temperature of the beryllium or beryllium alloy body. The anneal can be a separate operation or a continuation of the plastic deformation operation.

5 Claims, No Drawings

FINE GRAIN BERYLLIUM BODIES

BACKGROUND OF THE INVENTION

The preferred method of manufacture of most metals and alloys is by casting followed by mechanical working to break up the coarse cast microstructure and improve the mechanical properties. For beryllium, however, this technique is used only to a limited extent because grain size can be reduced by mechanical working of the type described herein to a typical value of 75 um at the minimum temperature of 1500° F at which the beryllium microstructure is fully recrystallized. This coarse structure results in a body of low strength and ductility. Because of this problem, most structural beryllium is made by hot pressing beryllium powder which maintains a fine grain size, typically 20 um, by virtue of BeO particles formed during powder manufacture. The fine grained hot pressed bodies exhibit mechanical properties superior to cast bodies. BeO particles cannot be used to grain refine cast beryllium bodies since BeO is insoluble in molten beryllium and of different density from beryllium. As such, BeO particles segregate during the casting operation and are not distributed uniformly enough to produce a refined grain structure.

SUMMARY OF THE INVENTION

Briefly, in accordance with the invention, there is described a process for improving the mechanical properties of cast beryllium and beryllium alloy bodies by reducing beryllium grain size. More particularly, by the process of the invention, enhanced mechanical properties are produced by introducing into a beryllium or beryllium alloy melt certain alloying elements which form a soluble metal beryllide phase in the molten beryllium. The alloying elements must have a low solubility in solid beryllium at room temperature so that their presence in solid solution in the beryllium does not cause embrittlement. Preferred alloying elements fulfilling these requirements and capable of meeting the parameters of subsequent processing steps are chromium, vanadium and titanium. The lower limit of effectiveness is about 0.01 percent by weight with the practical maximum limit of 1.0 percent by weight being established by the embrittling action in the cast body of larger quantities of the alloying elements.

The beryllium melt containing the metal beryllide phase is then cast and solidified, the metal beryllide phase during solidification precipitating as fine particles in the beryllium grain boundaries. Preferably, the particle size is 0.5 um or less in diameter so that they are present in sufficient numbers to be effective. The solidified cast body is then mechanically worked in conventional fashion below its recrystallization temperature to form an unstable deformed grain structure which is converted to a fine grain structure during a subsequent anneal, typically in argon or vacuum, above the beryllium recrystallization temperature. When a beryllium body with 0.50 percent by weight chromium is annealed at 1500° F, the resulting grain size is 20 um which is the typical value found for hot pressed beryllium powder. In contrast, identical processing of a cast body without the chromium additions results in a grain size of 75 um. It is of course realized that more severe mechanical working operations would cause the grain size in both conventional beryllium bodies and beryllium bodies of the invention to be finer than described above but the ratios of the grain sizes would be maintained.

DESCRIPTION OF THE PREFERRED EMBODIMENTS

In accordance with the invention, the preferred alloying elements forming metal beryllides of the required size, distribution and stability at elevated temperatures are chromium, vanadium and titanium. Nickel, although resulting in a finer grain size than that obtainable in cast bodies without alloying additions, is not as satisfactory as these elements since it is soluble in beryllium to an appreciable extent and therefore cannot form stable compounds of the type produced by chromium, titanium and vanadium. Since chromium, vanadium and titanium, having atomic numbers 22 through 24, exhibit superior characteristics, it is scientifically predictable that the other members of Groups IVB, VB and VIB of the Periodic Table of Properties of the Elements will behave in similar fashion. These elements are zirconium, niobium, molydenum (having atomic numbers 40 through 42) and hafnium tantalum and tungsten (having atomic numbers 72 through 74). The lower limit of effectiveness is about 0.01 percent by weight with the practical maximum limit of about 1.0 percent by weight being established by the embrittling action in the cast body of larger quantities of the elements. A more preferred range is about 0.08 percent by weight to about 1.0 percent by weight with the optimum range being about 0.1 percent by weight to about 0.5 percent by weight.

The alloying elements are added to the beryllium or beryllium alloy melt and the normal melting practice described, for example, in "Beryllium Its Metallurgy and Its Properties," H. H. Hauser, University of California Press 1965, pp. 55–67, is followed to ensure a uniform distribution of the elements in the melt. The melt is then cast into a mold and cooled conventionally to room temperature as described, for example, in the preceding article. During cooling a metal beryllide phase precipitates as fine particles no greater than 0.5 um in the beryllium grain boundaries. After the casting has solidified, it is mechanically deformed in a conventional manner (see, for example, "The Metal Beryllium," edited by White and Bruce, American Society for Metals, 1955, pp. 241–272) by rolling, extrusion, forging and the like with some part of the working operation being below the recrystallization temperature to form an unstable deformed grain structure which is converted during a subsequent annealing step into a fine grain structure. Typically, at least a 20 percent reduction and preferably a 50 percent reduction in thickness of the body is utilized to achieve the desired unstable deformed grain structure but the body may be worked further since there is no theoretical limit to the amount of work the body may undergo. Working is conducted at an elevated temperature, preferably from about 800° F to 2000° F depending on the composition of the cast body, to promote plastic deformation. Lower temperatures can be utilized but are not preferred since plastic deformation is more difficult to achieve. The maximum temperature to form the deformed grain structure must be below the recrystallization temperature of the body.

After cold working, the body is annealed above its recrystallization temperature to produce a fine, recrystallized grain size. The particular recrystallization temperature of a given cast body is dependent upon its composition and is readily ascertainable. Temperatures which greatly exceed the recrystallization temperature are not preferred since they promote grain growth in the microstructure to the detriment of mechanical properties. The annealing temperature decreases as the amount of cold work introduced into the cast body increases. A typical range of annealing temperatures is from about 1400° F to about 2250° F. Typically, enhanced mechanical properties are realized from anneals of one to five hours duration. However, in view of the number of beryllium alloys susceptible of being processed by the instant invention, the specific temperature-time relationship for a given cold worked body is readily ascertainable in accordance with the preceding teachings.

The enhancement in grain refinement resulting from alloying additions in accordance with the instant invention is illustrated in Table 1 which gives the values of mean grain diameters achieved for several cast beryllium bodies which were reduced 70 percent by rolling at 1400° F and annealed for one hour at the indicated temperatures. The bodies containing chromium, titanium and vanadium additions evidenced a significantly reduced grain size at all temperatures as compared to the beryllium body containing no alloying element. The nickel-containing body also evidenced at the lower temperature a significantly reduced grain size. It is well established for beryllium and most metals that strength and ductility are both increased by grain refinement; see, for example, "The Metal Beryllium," edited by White and Burke, American Society for Metals, 1955, pp. 162–163 and 238–239; "Physical Metallurgy of Beryllium," DMIC Report No. 30, June 1966, pp. 26–28.

TABLE 1

| % Alloying Element | Grain Size (μm) | | |
|---|---|---|---|
| | 1,500° F - 1 hr. | 1,800° F - 1 hr. | 2,000 ° F - 1 hr. |
| None | 75 | 101 | 130 |

TABLE 1-continued

| % Alloying Element | Grain Size (μm) | | |
|---|---|---|---|
| | 1,500° F - 1 hr. | 1,800° F - 1 hr. | 2,000 ° F - 1 hr. |
| 0.10 Cr | 27 | 58 | 58 |
| 0.25 Cr | 25 | 31 | 46 |
| 0.50 Cr | 20 | 29 | 45 |
| 0.08 Ti | 38 | 40 | 54 |
| 0.13 V | 19 | 42 | 49 |
| 0.08 Ni | 44 | 115 | 138 |

What is claimed is:

1. A method for reducing cast beryllium and beryllium alloy grain size comprising the steps of adding to molten beryllium from about 0.01 percent by weight to about 1.0 percent by weight of at least one element selected from the group of elements having atomic numbers 22 through 24, 28, 40 through 42, and 72 through 74, said metal forming a soluble metal beryllide phase in said molten beryllium, casting and solidifying said melt, said soluble metal beryllide phase precipitating in particulate form 0.5 um or less in diameter in the solid beryllium, mechanically deforming said casting at least 20 percent below its recrystallization temperature to form an unstable grain structure, and converting said unstable grain structure into a fine grain structure by annealing said mechanically deformed casting above its recrystallization temperature.

2. A method in accordance with claim 1 wherein said element is selected from the group of elements having atomic numbers 22 through 24 and 28.

3. A method in accordance with claim 2 wherein said element is selected from the group of elements consisting of chromium, vanadium and titanium.

4. A method in accordance with claim 3 wherein said elements are present in an amount from about 0.08 percent by weight to about 1.0 percent by weight.

5. A method in accordance with claim 4 wherein said elements are present in an amount from about 0.1 percent by weight to about 0.5 percent by weight.

* * * * *